US005746130A

United States Patent [19]

Andl et al.

[11] Patent Number: 5,746,130

[45] Date of Patent: May 5, 1998

[54] DEVICE FOR WASHING THE OUTER CYLINDRICAL SURFACE OF A CYLINDER OF A ROTARY PRINTING PRESS

[75] Inventors: Günter Andl, Sandhausen; Rolf Kernbach, Neidenstein, both of Germany

[73] Assignee: Heidelberger Druckmaschinen Aktiengesellschaft, Heidelberg, Germany

[21] Appl. No.: 515,793

[22] Filed: Aug. 16, 1995

[30] Foreign Application Priority Data

Aug. 16, 1994 [DE] Germany ..... 44 29 047.0

[51] Int. Cl.[6] ..... B41F 35/00

[52] U.S. Cl. ..... 101/424; 101/425

[58] Field of Search ..... 101/424, 425, 101/423

[56] References Cited

U.S. PATENT DOCUMENTS

| | | | |
|---|---|---|---|
| 761,633 | 5/1904 | Humphrey | 101/424 |
| 3,422,758 | 1/1969 | Brewster | 101/425 |
| 3,673,959 | 7/1972 | Jezuit et al. | 101/425 |
| 3,874,394 | 4/1975 | Robertson | 101/425 |
| 4,058,059 | 11/1977 | Moestue | 101/425 |
| 4,066,017 | 1/1978 | Garcowski et al. | 101/425 |
| 4,270,450 | 6/1981 | Difflipp et al. | 101/142 |
| 4,344,362 | 8/1982 | Ishii | 101/425 |
| 4,624,182 | 11/1986 | Pyliotis | 101/147 |
| 5,103,730 | 4/1992 | Sarda | 101/425 |
| 5,213,425 | 5/1993 | Adachi et al. | 400/572 |
| 5,447,102 | 9/1995 | Pfeiffer et al. | 101/492 |

FOREIGN PATENT DOCUMENTS

| | | | |
|---|---|---|---|
| 0478493 | 4/1992 | European Pat. Off. . | |
| 1130830 | 12/1962 | Germany . | |
| 161119 | 11/1970 | Germany . | |
| 56-55260 | 5/1981 | Japan . | |
| 0038163 | 3/1983 | Japan | 101/425 |
| 0969230 | 9/1964 | United Kingdom . | |
| 1319880 | 6/1973 | United Kingdom . | |
| 2047623 | 12/1980 | United Kingdom . | |

*Primary Examiner*—Edgar S. Burr
*Assistant Examiner*—Anthony H. Nguyen
*Attorney, Agent, or Firm*—Nils H. Ljungman and Associates

[57] ABSTRACT

A device for washing the outer cylindrical surface of a cylinder of a rotary printing press comprising a reservoir containing cleaning fluid as well as rollers for metering and applying cleaning fluid onto the outer cylindrical surface and for removing ink residues from said outer cylindrical surface, thus ensuring a uniform cleaning over a number of wash-up runs, without increasing the consumption of cleaning fluid, and without causing additional maintenance work.

20 Claims, 3 Drawing Sheets

DEVICE FOR WASHING THE OUTER CYLINDRICAL SURFACE OF A CYLINDER OF A ROTARY PRINTING PRESS

BACKGROUND OF THE INVENTION

1. Field of the Invention

The present invention generally relates to a device for washing the outer cylindrical surface of a cylinder of a rotary printing press or machine, the device comprising: a reservoir containing the cleaning fluid; and rollers for metering and applying the cleaning fluid onto the aforementioned outer cylindrical surface and for removing ink residues therefrom.

2. Background Information

German Laid Open Patent Application No. 16 11 191 shows a cleaner system for printing machine cylinders, wherein a roller supplies the outer cylindrical surface with cleaning fluid. A wiper, having a sponge-type structure, is provided to remove the loosened ink residues from the roller. Via the wiper, the cleaning fluid is conveyed onto the roller; i.e. the spongy wiper is soaked with cleaning fluid. However, after several wash-up runs of the outer cylindrical surface, the cleaning-body surface which is in contact with the roller can become very soiled so that the cleaning-body surface has to be replaced. With this known device, the cleaning effect of the wiper body thus decreases with the number of wash-up runs. As a result, ink residues will likely no longer removed completely. The removal and the washing of the wiper require further additional efforts, including a greater quantity of cleaning fluid.

When using cloths to clean the outer cylindrical surface, it is also often necessary to exchange the used cloths and to dispose of them, thus resulting in higher costs.

OBJECT OF THE INVENTION

Proceeding from the known wash-up devices described above, it is an object of the present invention to ensure a uniform cleaning of the outer cylindrical surface in a number of wash-up runs, without increasing the consumption of cleaning fluid, while preventing additional maintenance work and an additional use of auxiliary arrangements such as cleaning cloths or the like.

SUMMARY OF THE INVENTION

According to at least one preferred embodiment of the present invention, the above object can be achieved with a wiper roller featuring an absorbent covering which is wetted with cleaning fluid, wherein a metering roller is assigned to the wiper roller and a wash-up roller is assigned to the metering roller, wherein the wash-up roller is mounted so as to be engageable at the cylinder, and wherein, in an engaged position, there is a drive connection between the cylinder, wash-up roller and metering roller.

Due to the fact that, in accordance with at least one preferred embodiment of the present invention, the metering roller and wash-up roller are driven, the ink residues are removed from the outer cylindrical surface, with the wiper roller supplying the rollers with cleaning fluid. Then the ink residues removed are preferably conveyed to the outer cylindrical surface of the wiper roller, which wiper roller preferably rotates at very low speed or not at all, so that the outer cylindrical surface is completely cleaned in a short time. The cleaning fluid supplied essentially removes the ink residues conveyed onto the wiper roller from the absorbent covering of said wiper roller.

In an advantageous embodiment of the invention, the rollers and the reservoir can be supported, on both sides thereof, in a bearing plate so that the wiper roller immerses, with part of its outer cylindrical surface, in the cleaning fluid. Thus, the wash-up device may be easily engaged at the outer cylindrical surface and the wiper roller can be essentially continuously supplied with cleaning fluid.

Another advantageous embodiment of the invention is characterized in that the drive connection can be effected via spur gears, whereby, when being in an engaged position, the spur gear of the wash-up roller meshes with a spur gear of the cylinder.

Another advantageous embodiment of the invention is characterized in that the wiper roller can be driven via a rotary drive, making the wiper roller rotate during and after each wash-up run, so that the soiled portion of the outer cylindrical surface immerses in the cleaning fluid and the ink residues are flushed out. This modified solution ensures that, with each new wash-up run, a clean portion of the outer cylindrical surface of the wiper roller is available, and that there is sufficient time to flush out the ink residues from the outer cylindrical surface of the wiper roller, without requiring additional efforts.

Further advantageous embodiments are achieved by designing the rotary drive as a ratchet-type control unit, by providing a plurality of wash-up rollers and metering rollers, and by providing each of the wash-up rollers with an elastic covering. This can ensure that dirt particles are reliably loosened and removed and that the cleaning fluid is sensitively metered so that the wash-up device can work with very little amounts of cleaning fluid.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

In summary, one aspect of the invention resides broadly in a printing press comprising: a frame; a plate cylinder being rotatably mounted on the frame; an ink reservoir for holding a supply of ink; an inking mechanism for transferring the ink between the ink reservoir and the plate cylinder during operation of the printing press; the inking mechanism comprising a plurality of inking rollers for transferring ink from the ink reservoir to the plate cylinder; a blanket cylinder being rotatably mounted on the frame and having means for being engaged with the plate cylinder during operation of the printing press; means for washing a predetermined one of the following cylinders and rollers: the blanket cylinder; the plate cylinder; and one of the inking rollers; each of the blanket cylinder, the plate cylinder, and the plurality of inking rollers having an external surface; the washing means comprising: a reservoir for containing washing fluid; means for accepting washing fluid from the reservoir and at least temporarily retaining a portion of washing fluid accepted from the reservoir; the accepting and retaining means for being at least partly immersed in the washing fluid in the reservoir; means for transferring washing fluid from the accepting and retaining means, to the predetermined one of the cylinders and rollers; and means for moving the accepting and retaining means so as to selectively provide fresh washing fluid to the transferring means.

Another aspect of the invention resides broadly in washing apparatus for a printing press, for washing a predetermined one of the following cylinders and rollers: a blanket cylinder in a printing press, a plate cylinder in a printing press, and one of a plurality of inking rollers in a printing press; each of the blanket cylinder, the plate cylinder, and the plurality of inking rollers having an external surface; the washing apparatus comprising: a reservoir for containing washing fluid; means for accepting washing fluid from the reservoir and at least temporarily retaining a portion of washing fluid accepted from the reservoir; the accepting and retaining means for being at least partly immersed in the washing fluid in the reservoir; means for transferring washing fluid from the accepting and retaining means, to the predetermined one of the cylinders and rollers in a printing press; and means for moving the accepting and retaining means so as to selectively provide fresh washing fluid to the transferring means.

Yet another aspect of the invention resides broadly in a method of operating a printing press, such a printing press comprising: a frame; a plate cylinder being rotatably mounted on the frame; an ink reservoir for holding a supply of ink; an inking mechanism for transferring the ink between the ink reservoir and the plate cylinder during operation of the printing press; the inking mechanism comprising a plurality of inking rollers for transferring ink from the ink reservoir to the plate cylinder; and a blanket cylinder being rotatably mounted on the frame and having means for being engaged with the plate cylinder during operation of the printing press; the method comprising the steps of: providing a frame; providing a plate cylinder and rotatably mounting the same on the frame; providing an ink reservoir for holding a supply of ink; providing an inking mechanism for transferring the ink between the ink reservoir and the plate cylinder during operation of the printing press; the step of providing the inking mechanism comprising the step of providing a plurality of inking rollers for transferring ink from the ink reservoir to the plate cylinder; providing a blanket cylinder and rotatably mounting the same on the frame; the step of providing the blanket cylinder comprising the step of providing means for being engaged with the plate cylinder during operation of the printing press; providing means for washing a predetermined one of the following cylinders and rollers: the blanket cylinder; the plate cylinder; and one of the inking rollers; configuring each of the blanket cylinder, the plate cylinder, and the plurality of inking rollers to have a external surface; the step of providing the washing means comprising the steps of: providing a reservoir for containing washing fluid; providing means for accepting washing fluid from the reservoir and at least temporarily retaining a portion of washing fluid accepted from the reservoir; at least partly immersing the accepting and retaining means in the washing fluid in the reservoir; providing means for transferring washing fluid from the accepting and retaining means, to the predetermined one of the cylinders and rollers; and providing means for moving the accepting and retaining means so as to selectively provide fresh washing fluid to the transferring means; the method further comprising the additional steps of: washing a predetermined one of the following cylinders and rollers: the blanket cylinder; the plate cylinder; and one of the inking rollers; the washing step comprising the steps of: accepting washing fluid from the reservoir with the accepting and retaining means; at least temporarily retaining, with the accepting and retaining means, a portion of washing fluid accepted from the reservoir; transferring, with the transferring means, washing fluid from the accepting and retaining means, to the predetermined one of the cylinders and rollers; and moving the accepting and retaining means so as to selectively provide fresh washing fluid to the transferring means.

BRIEF DESCRIPTION OF THE DRAWINGS

A specimen embodiment of the invention is schematically illustrated in the accompanying drawings, wherein.

DESCRIPTION OF THE PREFERRED EMBODIMENT

Figure 1:
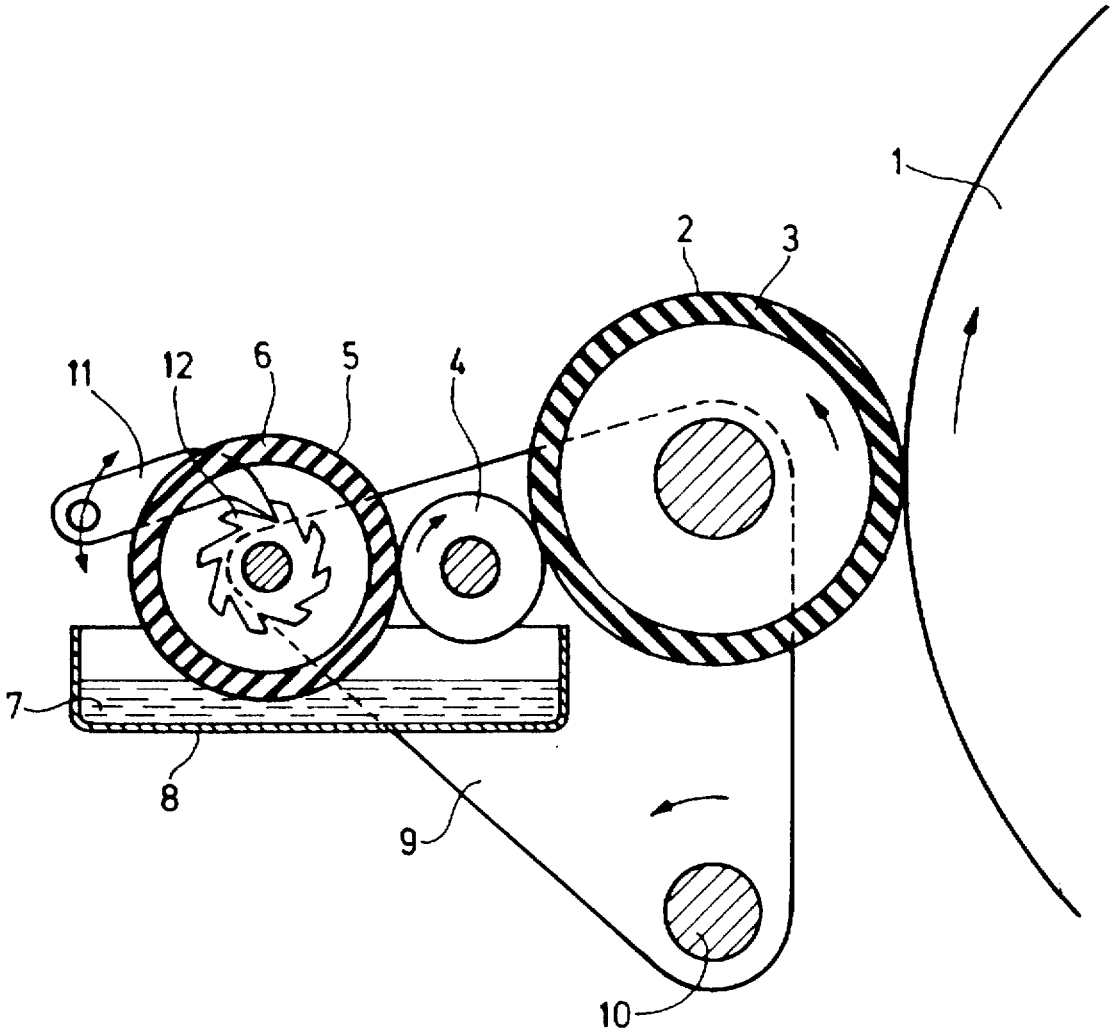
FIG. 1 shows a side elevational view of a wash-up device engaged at a cylinder.

With reference first to FIG. 1, cylinder 1 of a rotary printing machine may, for example, be a blanket cylinder of an offset printing machine transferring the printing image onto the material to be printed.

In practice, it is highly desirable to clean the outer cylindrical surface of cylinder 1 at certain intervals and to remove the soiling and ink particles adhering thereto in order to obtain virtually perfect print results.

According to at least one preferred embodiment of the present invention, a wash-up roller 2 is preferably engaged at the outer cylindrical surface of cylinder 1, the wash-up roller comprising an elastic covering 3. A metering roller 4 is preferably engaged at the wash-up roller 2, and preferably transfers fresh cleaning fluid from a wiper roller 5 onto the wash-up roller 2, and preferably returns dirty cleaning fluid from the wash-up roller 2 back to the wiper roller 5. When in an engaged position, both the wash-up roller 2 and the metering roller 4 are preferably in a drive connection with cylinder 1, the drive connection preferably being advantageously designed as a spur-gear drive (see FIG. 1*a* and the accompanying description herebelow). The spur gears, which are not illustrated in FIG. 1, are preferably located on a front side of the cylinder and the rollers, respectively.

The wiper roller 5 is preferably provided with an absorbent covering 6, the absorbent covering 6 immersing in the cleaning fluid 7 contained in a reservoir 8. The absorbent covering 6 is thus preferably always wetted with cleaning fluid and may transfer the cleaning fluid to the metering roller 4. Advantageously, the wiper roller 5 preferably does not perform any rotary movement during a wash-up run so that the soiled cleaning fluid returned is collected in an area of the outer cylindrical surface. After the wash-up run, the wiper roller 5 may be rotated by a certain amount so that a clean portion of the outer cylindrical surface is available for the subsequent wash-up run.

Wash-up roller 2, metering roller 4 and wiper roller 5 with reservoir 8 are preferably supported, on both sides thereof, in a bearing plate 9 swivellable on a pivot 10 so that the wash-up roller 2 may be engaged at, and disengaged from, the outer cylindrical surface of cylinder 1, respectively.

Figure 1A:
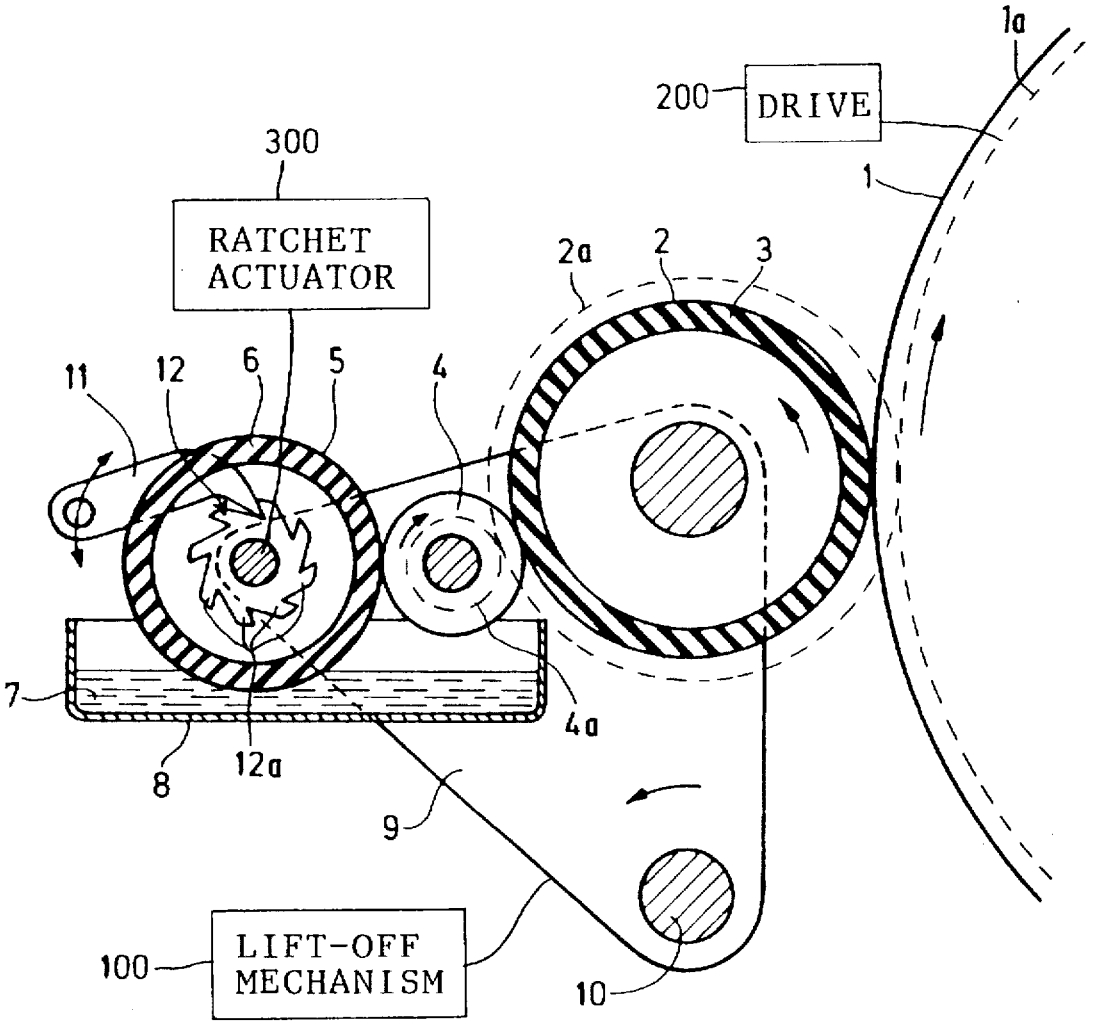
FIGS. 1*a* and 1*b* are, respectively, essentially the same view as FIG. 1, but showing additional components.
Figure 1B:
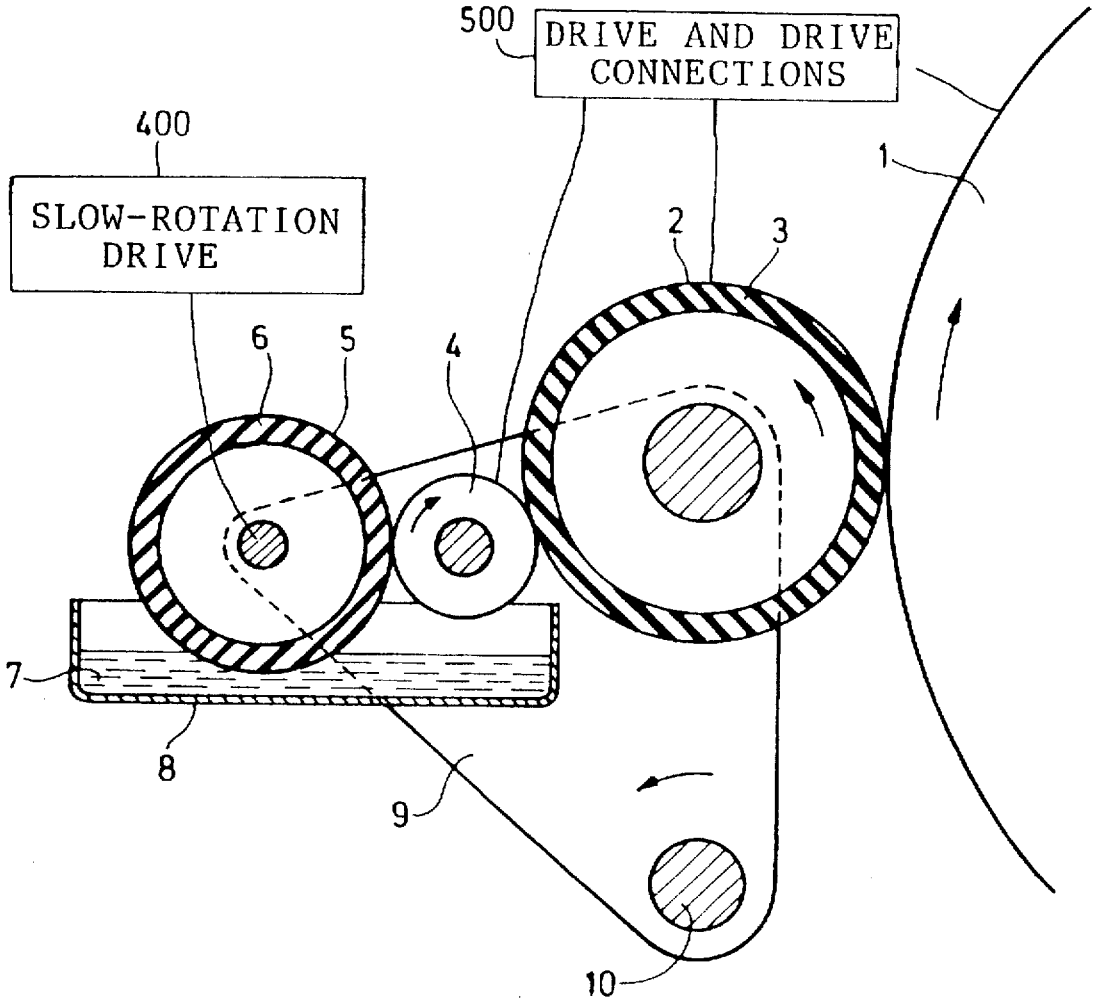

Preferably, in accordance with at least one preferred embodiment of the present invention, the arrangement of bearing plates 9 and pivot 10 will preferably permit wash-up roller 2, metering roller 4 and wiper roller 5 to move away from cylinder 1 as an ensemble. Particularly, as shown in FIG. 1*a*, a suitable lift-off mechanism 100 will preferably be configured to pivotally actuate bearing plates 9 in a direction away from cylinder 1, thus simultaneously affording the disengagement of wash-up roller 2 and cylinder 1 with respect to one another and the movement of all of wash-up roller 2, metering roller 4 and wiper roller 5 generally away from cylinder 1 as an ensemble. Examples of such lift-off mechanisms 100 will generally be well-known to those of ordinary skill in the art and thus will not be described in any further detail herein. Preferably, the reservoir 8 may remain stationary, with the result that wiper roller 5 may become slightly more immersed in fluid 7 of reservoir 8 when bearing plates 9 are pivoted away from cylinder 1. Alternatively, reservoir 8 may also be pivotably mounted with respect to bearing plates 9, with a suitable arrangement being provided to permit the reservoir 8 to remain essentially horizontal while bearing plates 9 pivot.

According to at least one preferred embodiment of the present invention, the wiper roller 5 can be driven via a rotary drive which, for example, may be designed as a ratchet-type control unit comprising a ratchet 11 and a ratchet wheel 12. Thus, the wiper roller 5 may be rotated by a certain angle of rotation after each wash-up run. As a result thereof, a clean portion of the outer cylindrical surface will essentially be available for the subsequent wash-up run, and the soiled area of the outer cylindrical surface will essentially immerse in the cleaning fluid 7 so that the ink residues adhering thereto are flushed out.

When handling print jobs which cause a high degree of soiling on the outer cylindrical surface of a cylinder, it is conceivable, within the scope of the present invention, to engage, for example, two wash-up rollers 2 at the outer cylindrical surface of cylinder 1. As an alternative, two metering rollers 4 may be provided so that a larger amount of cleaning fluid may be supplied to the outer cylindrical surface and a larger amount of soiled cleaning fluid may be discharged.

FIG. 1*a* schematically illustrates a possible configuration of cooperating spur gears 1*a*, 2*a* and 4*a*, corresponding respectively to cylinder 1, wash-up roller 2 and metering roller 4, in accordance with at least one preferred embodiment of the present invention. Spur gear arrangements will be generally well-known to those of ordinary skill in the art, and will thus not be discussed any further herein.

Conceivably, a dedicated drive 200, independent of any general printing press drive, may be provided for the arrangement of spur gears 1*a*, 2*a* and 4*a*. Alternatively, drive 200 could possibly correspond to the printing press drive itself. Since both of these possibilities are conceivable within the scope of the present invention, it will be appreciated that the common denominator is essentially that a common drive is provided for the simultaneous driving of cylinder 1, wash-up roller 2 and metering roller 4. Of course, it is conceivable to utilize arrangements other than spur gears within the scope of the present invention, for the purpose of permitting a cooperated driving relationship of cylinder 1, wash-up roller 2 and metering roller 4 with respect to one another.

From the foregoing, it will be appreciated that, in accordance with at least one preferred embodiment of the present invention, the wiper roller 5 may essentially act as a stationary supply of cleaning fluid 7 during a cleaning operation, while having the capability of being easily refreshed and replenished prior to a subsequent cleaning operation. In other words, in accordance with at least one preferred embodiment of the present invention, although the wiper roller 5 may preferably remain stationary during a cleaning operation, with the metering roller 4, during rotation thereof, accepting cleaning fluid 7 from wiper roller 5, the wiper roller 5 can be rotated through a given angle of rotational displacement, subsequent to an initial cleaning operation and prior to a subsequent cleaning operation, in order to present a portion of its surface that is relatively clean and capable of supplying relatively clean cleaning fluid 7 to metering roller 4.

Depending on the intended depth of immersion of wiper roller 5 in cleaning fluid 7, the wiper roller 5 can preferably be configured, conceivably in conjunction with a ratchet 11 and ratchet wheel 12, so as to be selectively displaceable through a discrete angle of rotational displacement that optimally affords the capability of presenting a portion of the surface of wiper roller 5 to the metering roller 4 that contains clean cleaning fluid 7. Although FIG. 1*a* shows a ratchet wheel 12 having eight discrete and uniformly distributed ratchet portions or teeth 12*a*, allowing for a discrete rotational displacement of 45° corresponding to a single "stepped" rotational displacement from one ratchet portion 12*a* to an adjacent ratchet portion 12*a*, it is conceivable, within the scope of the present invention, to allow for greater or lesser degrees of discrete rotational displacement, as deemed appropriate for retaining the capability of providing clean cleaning fluid to metering roller 4. For example, it is conceivable, in the context of a ratchet wheel 12, to advance the ratchet wheel 12 by more than one ratchet portion 12*a*, if deemed appropriate. Thus, it is conceivable to advance the ratchet wheel 12 by, for example, about 90° or even about 270°, corresponding, respectively, to a one-quarter turn and a three-quarters turn of wiper roller 5.

With continued reference to FIG. 1*a*, it will be appreciated, then, that in accordance with a preferred embodiment of the present invention, an appropriate ratchet actuator 300 may preferably be provided for the purpose of actuating ratchet wheel 12, essentially to drive wiper roller 5 rotationally. Ratchet actuator 300 may, in one embodiment, be in the form of an automatic drive, with appropriate controls, allowing the same to drive wiper roller 5 over a discrete rotational displacement as discussed heretofore. Alternatively, ratchet actuator 300 could conceivably be embodied by a manual arrangement, such as a handwheel, affording the capability of advancing wiper roller 5 and ratchet wheel 12 over predetermined discrete rotational displacements. Of course, it is also conceivable, within the scope of the present invention, to drive wiper roller 5 with an arrangement that does not involve a ratchet wheel 12 but nonetheless provides essentially the same result; that is, the capability of advancing the wiper roller 5 over discrete rotational displacements without permitting the wiper roller 5 to displace in a reverse rotational direction with respect to the rotational direction in which it is originally being displaced.

Preferably, in accordance with at least one preferred embodiment of the present invention, and as will be apparent from FIGS. 1 and 1*a*, the ratchet arrangement (11, 12), or similar arrangement, for affording rotational displacement of wiper roller 5 in a predetermined, single rotational direction, will preferably afford rotational displacement of wiper roller 5 in the same direction as that undertaken by metering roller 4 during a washing operation. Thus, wiper roller 5 will preferably be prevented from rotating in a cooperatively engaged relationship with metering roller 4 during a washing operation, by virtue of the ratchet arrangement (11, 12) or similar arrangement.

In accordance with at least one preferred embodiment of the present invention, the ratchet actuator 300 or alternative device may preferably include a suitable "indexing" control arrangement for the purpose of providing discrete, graduated rotational advancements of wiper roller 5 and ratchet wheel 12, examples of which will be generally well-known to those of ordinary skill in the art.

It will be appreciated that, in accordance with at least one preferred embodiment of the present invention, the absorbent covering 6 of wiper roller 5 will preferably be composed of a material that is capable of retaining a fluid, such as cleaning fluid 7, over a significant period of time. Thus, it could be conceivable that the absorbent covering 6 may, throughout a major portion thereof, retain a quantity of clean cleaning fluid 7 while one or more cleaning operations are taking place. Such materials, including suitable sponge-type materials, will be generally well-known to those of ordinary skill in the art, and thus will not be described in any further detail herein.

Preferably, elastic covering 3 will be composed of a material that is sufficient for applying, to the outer surface of cylinder 1, a quantity of cleaning fluid 7 in an efficient and effective manner. Such materials will be generally well-known to those of ordinary skill in the art, and thus will not be described in any further detail herein.

As briefly stated heretofore, it is conceivable to allow the wiper roller 5 to rotate at a significantly low speed, at least with comparison to the rotational speed of wash-up roller 2 and metering roller 4, during a cleaning operation. Although such an arrangement would nominally differ from an arrangement in which the wiper roller 5 remains stationary during a cleaning operation (as described heretofore), it will, of course, still be possible to allow wiper roller 5 to present quantities of clean cleaning fluid to metering roller 4 during successive cleaning operations. Arrangements for affording such slow rotation of wiper roller 5, preferably through individual drive of wiper roller 5, will generally be well-known to those of ordinary skill in the art, and thus do not appear to warrant further discussion herein. However, FIG. **1*b* schematically illustrates the provision of a suitable slow-rotation drive 400 for this purpose, while cylinder 1, wash-up roller 2 and metering roller 4 will preferably be simultaneously driven by a given arrangement of drive and drive connections 500. Conceivably, a slow-rotation driving arrangement 400 could be provided in conjunction with a ratchet arrangement (11, 12) such as that described heretofore and illustrated in FIG. 1, with the proviso that the ratchet wheel 12 and wiper roller 5** could be continuously driven, over predetermined increments of angular displacement, at slow speed, with given intervals of time between the increments.

Conceivably, it may not be necessary for wiper roller 5, and its absorbent covering 6, to be immersed at all in washing fluid 7 during or even after a washing operation. Particularly, it is conceivably to render roller 5 selectively immersable into the washing fluid 7 contained in reservoir 8.

Generally, the spur gears discussed heretofore (such as components **1*a*, 2*a* and 4*a* shown in FIG. 1*a*** may, in accordance with at least one preferred embodiment of the present invention, be considered to be a type of gear that is essentially coaxial with respect to the corresponding cylinder or roller in question and non-rotatable with respect to the corresponding cylinder or roller in question. Such spur gears may, in accordance with at least one preferred embodiment of the present invention, conceivably have teeth that run essentially axially with respect to the rotational axes of the corresponding cylinders and rollers, or may conceivably have teeth that are skewed, diagonal or helical with respect to the rotational axes of the corresponding cylinders.

One feature of the invention resides broadly in the device for washing the outer cylindrical surface of a cylinder of a rotary printing machine comprising a reservoir containing cleaning fluid, characterized in that a wiper roller features an absorbent covering 6 which is wetted with cleaning fluid, that a metering roller 4 is assigned to said wiper roller 5, and a wash-up roller 2 is assigned to said metering roller 4, that said wash-up roller 2 is mounted so as to be engageable at a cylinder 1, and that, in an engaged position, there is a drive connection between cylinder 1, wash-up roller 2 and metering roller 4.

Another feature of the invention resides broadly in the device characterized in that the rollers 2, 4, 5 and the reservoir 8 are supported, on both sides thereof, in a bearing plate 9, and that part of the wiper roller 5 immerses with its outer cylindrical surface in the cleaning fluid 7.

Yet another feature of the invention resides broadly in the device characterized in that the drive connection is effected via spur gears, whereby, when being in an engaged position, the spur gear of the wash-up roller meshes with a spur gear of cylinder 1.

Still another feature of the invention resides broadly in the device characterized in that the wiper roller 5 can be driven via a rotary drive rotating said wiper roller 5 during and after each wash-up run so that the soiled portion of the outer cylindrical surface immerses in the cleaning fluid 7 and the ink residues are flushed out.

A further feature of the invention resides broadly in the device characterized in that the rotary drive is designed as a ratchet-type unit 11, 12.

Another feature of the invention resides broadly in the device characterized in that there is provided a plurality of wash-up rollers 2 and/or metering rollers 4.

Examples of general components relating to printing presses, which may be utilized in accordance with the embodiments of the present invention, may be found in the following U.S. patents: U.S. Pat. No. 5,010,820, which issued to Löffler on Apr. 30, 1991; and U.S. Pat. No. 5,081,926, which issued to Rodi on Jan. 21, 1992.

Examples of spur gear arrangements, having components which may be utilized in accordance with the embodiments of the present invention, may be found in the following U.S. patents: U.S. Pat. No. 4,915,284, which issued to Goda on Apr. 10, 1990; U.S. Pat. No. 5,016,318, which issued to Fukunaga on May 21, 1991; U.S. Pat. No. 5,147,255, which issued to Strehler et al. on Sep. 15, 1992; and U.S. Pat. No. 5,174,419, which issued to Strehler et al. on Dec. 29, 1992.

Examples of stepping motor arrangements and the like, having components which may be utilized in accordance with the embodiments of the present invention, may be found in the following U.S. patents: U.S. Pat. No. 5,187,400, which issued to Kurata on Feb. 16, 1993; U.S. Pat. No. 5,216,348, which issued to Ito on Jun. 1, 1993; U.S. Pat. No. 5,231,342, which issued to Bahn on Jul. 27, 1993; U.S. Pat. No. 5,255,601, which issued to Blass et al. on Oct. 26, 1993; U.S. Pat. No. 5,272,401, which issued to Lin on Dec. 21, 1993.

Examples of indexing control arrangements and the like, having components which may be utilized in accordance with the embodiments of the present invention, may be found in the following U.S. patents: U.S. Pat. No. 5,189,846, which issued to Griswold on Mar. 2, 1993; U.S. Pat. No. 5,205,110, which issued to Buchko on Apr. 27, 1993; U.S. Pat. No. 5,341,702, which issued to Chaney et al. on Aug. 30, 1994; U.S. Pat. No. 5,000,727, which issued to Hatchell et al. on Nov. 14, 1988; and U.S. Pat. No. 5,138,397, which issued to Dastin et al. on Sep. 6, 1991.

Examples of washing arrangements in printing presses, having components which may be utilized in accordance with the embodiments of the present invention, may be found in the following U.S. patents: U.S. Pat. No. 5,174,209, which issued to Rodi et al. on Dec. 29, 1992; U.S. Pat. No. 5,174,210, which issued to Rodi on Dec. 29, 1992; U.S. Pat. No. 5,365,949, which issued to Spiegel on Nov. 22, 1994; U.S. Pat. No. 5,375,522, which issued to Junghans on Dec. 27, 1994.

Examples of absorptive media for use on wiper roller 5, and elastic media for use on wash-up roller 2, which may be utilized in accordance with the embodiments of the present invention, may be found in the following U.S. patents: U.S. Pat. No. 3,422,758, which issued to Brewster on Jan. 21, 1969; and U.S. Pat. No. 4,066,017, which issued to Garcowski et al. on Jan. 3, 1978.

Examples of washing arrangements, of absorptive media suitable for use on wiper roller 5, and elastic media suitable for use on wash-up roller 2, which may be utilized in accordance with the embodiments of the present invention, may be found in the following patent publications: European Patent Application Publication No. 0 478 493 (MacConnell et al.); Japanese Patent Publication No. 56-55260; Federal Republic of Germany Patent No. 11 30 830 (Käufer et al.); British Patent No. 969,230 (Agfa AG); British Patent No. 1,319,880 (Chambon Limited).

Examples of lift-off arrangements, such as for removing a washing apparatus from a roller or cylinder, which may be utilized in accordance with the embodiments of the present invention, may be found in the following U.S. patents: U.S. Pat. No. 5,174,209, which issued to Rodi et al. on Dec. 29, 1992; U.S. Pat. No. 5,174,210, which issued to Rodi on Dec. 29, 1992; U.S. Pat. No. 5,365,949, which issued to Spiegel on Nov. 22, 1994; U.S. Pat. No. 5,375,522, which issued to Junghans on Dec. 27, 1994.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 44 29 047.0, filed on Aug. 16, 1994, having inventors Günter Andl and Rolf Kernbach, and DE-OS P 44 29 047.0 and DE-PS P 44 29 047.0, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A washing apparatus for washing a cylinder or a roller in a printing press, said washing apparatus comprising:

a reservoir for containing washing fluid;

an absorptive roller, said absorptive roller having an outer region and an absorptive medium disposed at said outer region, said absorptive medium being configured for absorbing and retaining washing fluid from said reservoir;

a metering roller for being engaged with said absorptive roller and for receiving washing fluid from said absorptive roller;

a washing roller for receiving washing fluid from said metering roller and applying the same to a cylinder or a roller, to wash a cylinder or a roller;

a first drive to move said absorptive roller so as to selectively provide fresh washing fluid to said metering roller and said washing roller;

a device to selectively engage and disengage said washing apparatus with respect to a cylinder or a roller in a printing press;

a second drive, independent of said first drive, to drive said washing roller and said metering roller with respect to one another, so as to be simultaneously driven by a cylinder or a roller in a printing press upon said washing apparatus being engaged with a cylinder or a roller in a printing press;

a structure to rotatably support each of said absorptive roller, said metering roller and said washing roller; and said support structure being configured to dispose said absorptive roller at least partly in said reservoir upon said washing apparatus being engaged with a cylinder or a roller in a printing press.

2. The washing apparatus according to claim 1, wherein:

said second drive comprises a gear arrangement; and said gear arrangement is configured and disposed to operatively engage a gear associated with a cylinder or a roller of a printing press.

3. The washing apparatus according to claim 2, wherein said first drive comprises an arrangement to rotate said absorptive roller in a single, predetermined rotational direction and simultaneously preventing rotation of said absorptive roller in a rotational direction opposite that of the single, predetermined rotational direction.

4. The washing apparatus according to claim 3, wherein:

said gear arrangement of said second drive comprises a spur gear;

said spur gear is fixedly and non-rotatably mounted with respect to said washing roller; and said metering roller is configured to rotate in a predetermined rotational direction during a washing operation, with said washing apparatus being engaged with a cylinder or a roller of a printing press.

5. The washing apparatus according to claim 4, wherein:

said arrangement to rotate said absorptive roller in a single, predetermined rotational direction comprises a ratchet unit; and said ratchet unit is configured to permit rotation of said absorptive roller against the predetermined direction of rotation of said metering roller and to prohibit cooperative rotation of said absorptive roller with said metering roller, at least with rotation of said metering roller in the predetermined direction of rotation of said metering roller.

6. The washing apparatus according to claim 5, wherein said support structure comprises a pair of bearing plates, each of said absorptive roller, said metering roller and said washing roller being rotatably mounted between said bearing plates.

7. The washing apparatus according to claim 6, wherein:

said washing roller comprises an elastic outer covering.

8. The washing apparatus according to claim 7, wherein said support structure comprises an arrangement being configured to pivotally displace said bearing plates towards and away from a cylinder or a roller of a printing press.

9. The washing apparatus according to claim 8, wherein at least a major portion of said metering roller is positioned substantially directly above said reservoir with said washing apparatus being engaged with a cylinder or a roller in a printing press.

10. The washing apparatus according to claim 9, further comprising at least one of:

at least one additional washing roller for applying washing fluid to a cylinder or a roller in a printing press; and at least one additional metering roller for receiving washing fluid from said absorptive roller and transferring the same to at least one of: said washing roller and said at least one additional washing roller.

11. A washing apparatus for washing a cylinder or a roller in a printing press, said washing apparatus comprising:

a reservoir for containing washing fluid;

an absorptive roller, said absorptive roller having an outer region and an absorptive medium disposed at said outer region, said absorptive medium being configured for absorbing and retaining washing fluid from said reservoir;

a metering roller for being engaged with said absorptive roller and for receiving washing fluid from said absorptive roller;

a washing roller for receiving washing fluid from said metering roller and applying the same to a cylinder or a roller, to wash a cylinder or a roller;

a first drive to move said absorptive roller so as to selectively provide fresh washing fluid to said metering roller and said washing roller;

a device to selectively engage and disengage said washing apparatus with respect to a cylinder or a roller in a printing press;

a second drive, independent of said first drive, to drive said washing roller and said metering roller with respect to one another independently of the driving of said absorptive roller by said first drive, said second drive being disposed to be simultaneously driven by a cylinder or a roller in a printing press upon said washing apparatus being engaged with a cylinder or a roller in a printing press;

a structure to rotatably support each of said absorptive roller, said metering roller and said washing roller; and said support structure being configured to dispose said absorptive roller at least partly in said reservoir.

12. The washing apparatus according to claim 11, wherein said first drive is configured to rotate said absorptive roller for at least one of: during a washing operation and after a washing operation, to immerse a soiled portion of said absorptive roller in said reservoir to flush ink residues from the soiled portion with washing fluid.

13. The washing apparatus according to claim 12, wherein:

said first drive comprises a ratchet mechanism;

said ratchet mechanism is configured to selectively prohibit cooperative rotation of said absorptive roller with said metering roller; and said ratchet mechanism is configured to selectively permit rotation of said absorptive roller in a predetermined direction and extent of rotational travel.

14. The washing apparatus according to claim 13, wherein:

said support structure comprises a pair of bearing plates, each of said absorptive roller, said metering roller and said washing roller being rotatably mounted between said bearing plates; and said reservoir is supported by said bearing plates.

15. The washing apparatus according to claim 14, wherein:

said second drive comprises a gear arrangement; and said gear arrangement is configured and disposed to operatively engage a gear associated with a cylinder or a roller of a printing press.

16. The washing apparatus according to claim 15, wherein:

said gear arrangement of said second drive comprises a spur gear;

said spur gear is fixedly and non-rotatably mounted with respect to said washing roller; and said spur gear is configured to operatively engage a spur gear associated with a cylinder or a roller of a printing press.

17. The washing apparatus according to claim 16, wherein at least a major portion of said metering roller is positioned substantially directly above said reservoir with said washing apparatus being engaged with a cylinder or a roller in a printing press.

18. The washing apparatus according to claim 17, wherein said support structure comprises an arrangement being configured to pivotally displace said bearing plates towards and away a cylinder or a roller of a printing press.

19. The washing apparatus according to claim 18, said washing apparatus further comprising at least one of: a plurality of metering rollers and a plurality of washing rollers.

20. The washing apparatus according to claim 19, wherein at least one washing roller comprises an elastic outer covering.

* * * * *

UNITED STATES PATENT AND TRADEMARK OFFICE

CERTIFICATE OF CORRECTION

PATENT NO. : 5,746,130

DATED : May 5, 1998

INVENTOR(S) : Günter ANDL and Rolf KERNBACH

It is certified that error appears in the above-identified patent and that said Letters Patent is hereby corrected as shown below:

On the title page, item [56], under the FOREIGN PATENT DOCUMENTS section, before '11/1970 Germany', delete "161119" and insert --1611191--.

Signed and Sealed this

Eighth Day of September, 1998

*Attest:*

*Attesting Officer*

Bruce Lehman

BRUCE LEHMAN

*Commissioner of Patents and Trademarks*